US007293769B2

(12) United States Patent
Asari et al.

(10) Patent No.: US 7,293,769 B2
(45) Date of Patent: Nov. 13, 2007

(54) SHEETS SEPARATION/CONVEYING APPARATUS

(75) Inventors: Yukio Asari, Kanagawa-ken (JP); Naruaki Hiramitsu, Kanagawa-ken (JP); Yoshihiko Naruoka, Kanagawa-ken (JP); Shinichi Ito, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 328 days.

(21) Appl. No.: 10/918,468

(22) Filed: Aug. 16, 2004

(65) Prior Publication Data

US 2005/0046102 A1 Mar. 3, 2005

(30) Foreign Application Priority Data

Sep. 1, 2003 (JP) ..... 2003-309246

(51) Int. Cl.
*B65H 7/02* (2006.01)

(52) U.S. Cl. ..... 271/258.01; 271/121; 271/265.01; 271/270

(58) Field of Classification Search ..... 271/258.01, 271/262, 265.01, 265.04, 270, 121, 122
See application file for complete search history.

(56) References Cited

U.S. PATENT DOCUMENTS 4,627,607 A * 12/1986 Ishii ..... 271/122
5,022,642 A * 6/1991 Hasegawa et al. ..... 271/10.12
5,152,522 A * 10/1992 Yamashita ..... 271/264
5,384,631 A * 1/1995 Matsunami ..... 399/370
6,005,687 A * 12/1999 Kawashima et al. ..... 358/498
6,263,186 B1 * 7/2001 Okamoto et al. ..... 399/388
6,394,446 B1 * 5/2002 Okamoto ..... 271/186
6,543,760 B1 * 4/2003 Andren ..... 271/99
2001/0022422 A1 * 9/2001 Tamura ..... 271/10.03
2002/0020957 A1 * 2/2002 Araki et al. ..... 271/10.11
2003/0038418 A1 * 2/2003 Isemura et al. ..... 271/10.01
2003/0080494 A1 * 5/2003 Abe et al. ..... 271/121

FOREIGN PATENT DOCUMENTS

JP 58-167338 10/1983
JP 59-12029 1/1984
JP 60-144256 A 7/1985
JP 62-157151 7/1987
JP 3-158342 A 7/1991
JP 2002-249261 9/2002

OTHER PUBLICATIONS

European Search Report dated Dec. 28, 2004 for Appln. No. 04 01 9218.

* cited by examiner

*Primary Examiner*—Patrick MacKey
*Assistant Examiner*—Kalyan Kumar
(74) *Attorney, Agent, or Firm*—Pillsbury Winthrop Shaw Pittman, LLP

(57) ABSTRACT

A sheets separation/conveying apparatus has a pick-up roller to take out sheets in the piled up state on the conveying path. The sheets taken out on the conveying path are checked when passing the first roller and plural sheets being conveyed in the overlapped state are detected by a detector and separated each other by the second roller.

13 Claims, 16 Drawing Sheets

$$|f_F| < |f_R|$$

SHEETS SEPARATION/CONVEYING APPARATUS

CROSS-REFERENCE TO RELATED APPLICATION

This application is based upon and claims the benefit of priority from the prior Japanese Patent Application No. 2003-309246, filed Sep. 1, 2003, the entire contents of all of which are incorporated herein by reference.

BACKGROUND OF THE INVENTION

1. Field of the Invention

The present invention relates to a sheet separation/conveying apparatus to separate and convey sheets that are in the piled up state.

2. Description of the Related Art

As a sheets separation/conveying apparatus, an apparatus to take out a number of sheets, which are accumulated and put therein and piled up, on a conveying path and separate them one by one and convey is so far known as disclosed in Japanese Patent Application Publication No. 2002-249261. This apparatus has a pick-up roller to rotate by contacting sheets at one end in the accumulating direction, a detecting portion to detect sheets taken out in the overlapped state on a conveying path by the pick-up roller, and a conveying portion to convey normal sheets taken out on the conveying path one by one to a processor at a latter stage.

Sheets taken out on the conveying path in the overlapped state; that is, sheets detected as being conveyed in the overlapped state are not conveyed to the processor at the latter stage but are once rejected and after completing one task, they are taken into the apparatus again.

Thus, in a conventional sheets separation/conveying apparatus, plural sheets detected as being conveyed in the overlapped state are once rejected and again put in the apparatus and therefore, there was such a problem that the through-put of the apparatus will drop.

SUMMARY OF THE INVENTION

It is an object of the present invention to provide sheets separation/conveying apparatus capable of executing the process continuously without rejecting sheets when the sheets conveyed in the overlapped state and increasing the process efficiency.

According to the present invention, there is provided a sheets separation/conveying apparatus comprising: a take-out portion to take out sheets on a conveying path by rotating in contact with sheets at the end of stacking direction; a conveying portion to convey the sheets taken out on a conveying path; an overlapped sheets detector to detect the sheets being conveyed in a overlapped state on the conveying path; a separating portion provided on the conveying path at the downstream side in the conveying direction from the overlapped sheets detector and separate the plural sheets conveyed in the overlapped state each other; and a controller to stop the operation to take out the sheets at the take-out portion when the sheets detected as being conveyed in the overlapped state.

DETAILED DESCRIPTION OF THE INVENTION

The embodiments of the present invention will be described below in detail referring to attached drawings.

Figure 1:
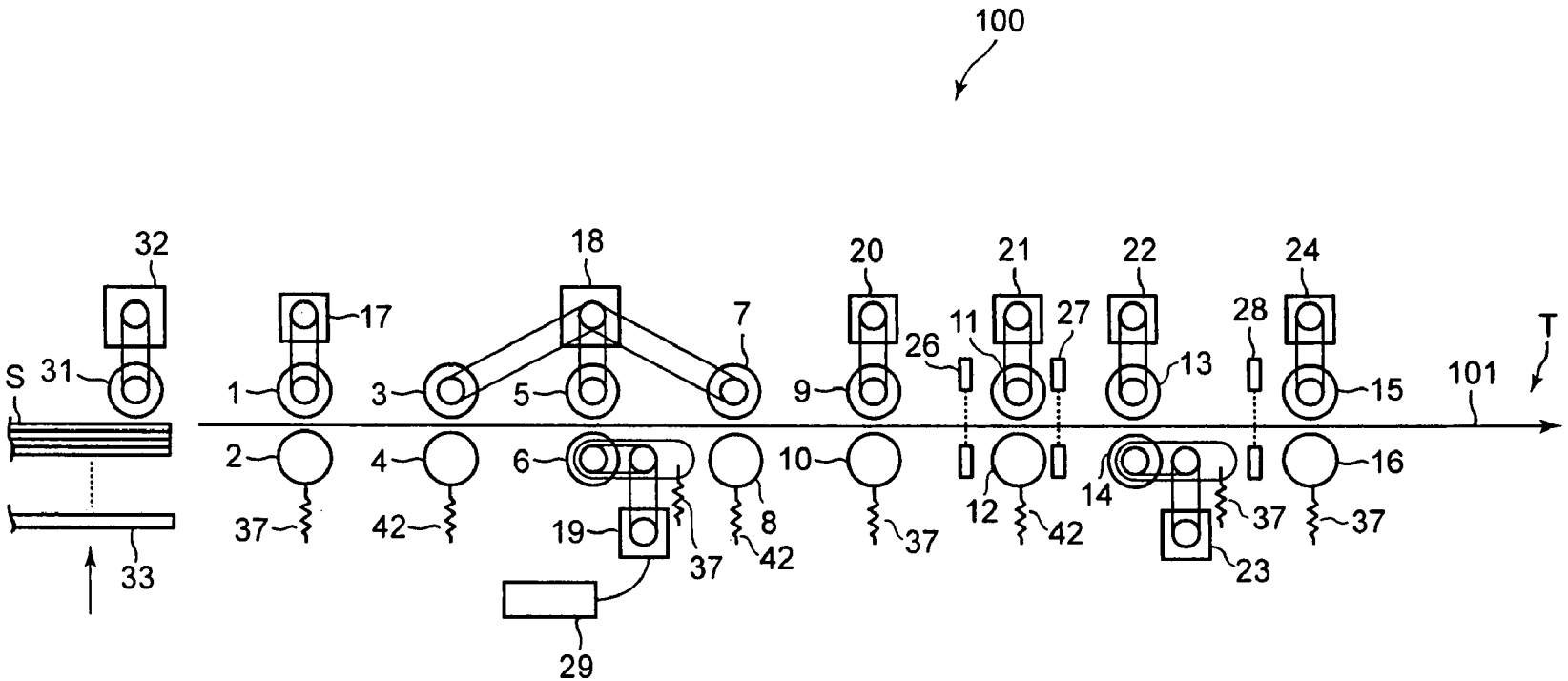
FIG. 1 is a schematic front view showing an embodiment of a sheets separation/conveying apparatus of this invention.

FIG. 1 shows the schematic construction of a sheets separation/conveying apparatus 100 (hereinafter, simply called as an apparatus 100) of the present invention involved in the embodiment.

Figure 2:
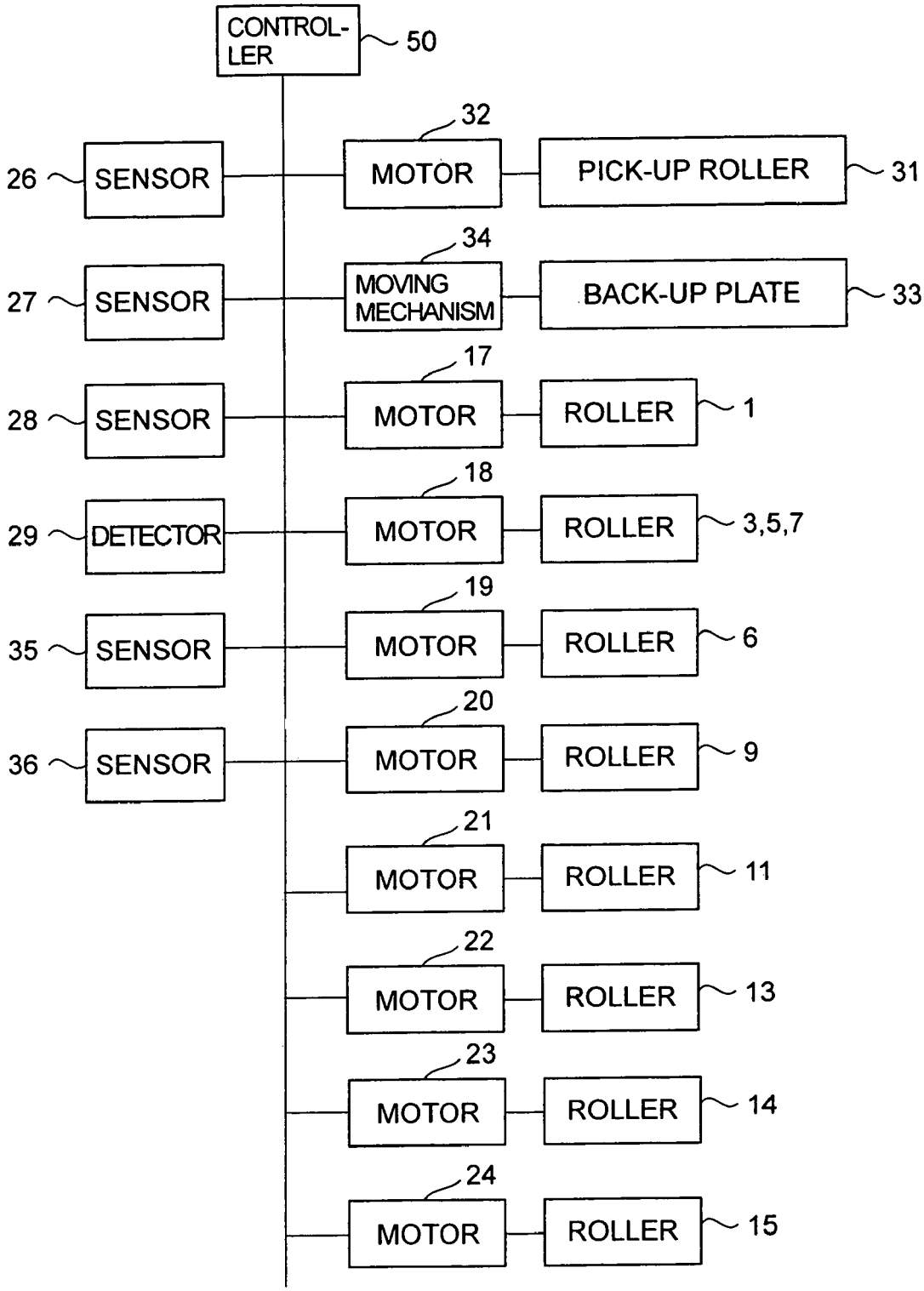
FIG. 2 is a block diagram showing a control system to control the operation of the apparatus shown in FIG. 1.

FIG. 2 shows a block diagram of a control system to control the operations of apparatus 100.

Apparatus 100 has an input portion to input plural sheets S in the piled up state that are objects for processing and a back-up plate 33 to face contact sheets at one end in the piled up direction as shown in FIG. 1. Back-up plate 33 is provided movable in the accumulating direction of sheets S (in the arrow direction in FIG. 1) by a moving mechanism 34 (refer to FIG. 2). That is, by moving back-up plate 33 properly according to the take-out of sheets, sheets S at the other end in the accumulating direction are always arranged to a specified take-out position.

At the position to contact sheets S at the other end in the accumulating direction out of input plural sheets, a pick-up roller 31 (a take-out portion) is provided. Pick-up roller 31 is turned and contacts a sheet S at the end with a specified pressure and is rotated by a motor 32. That is, sheets S arranged at the take-out position are taken out one by one on a conveying path 101 by the rotation of pick-up roller 31.

On conveying path 101 extending to the downstream side of pick-up roller 31, plural roller pairs are provided at positions facing each other with conveying path 101 between. Plural roller pairs on conveying path 101 function basically as conveying portions of the present invention to convey sheets S in the direction of arrow T along conveying path 101 while rotating in the state holding sheets S. In the explanation below, the rotating directions of the rollers conveying sheets S in the direction of arrow T along conveying path 101 are the forward direction.

More in detail, at the upper side of conveying path 101 in FIG. 1, that is, the same side of pick-up roller 31, rollers 1, 3, 5, 7, 9, 11, 13 and 15 are provided in order separately each other. Eight rollers provided above conveying path 101 in FIG. 1 are stationary to a frame (not shown) of apparatus 100 and rotatable, and the outer surfaces of these rollers are positioned to rotate in the forward direction along conveying path 101. Further, the third roller 5 provided along the conveying direction functions as the first roller of the present invention and the seventh roller 13 functions as a driving roller of this present invention.

At the positions below conveying path 101 in FIG. 1 and contacting the above-mentioned rollers 1, 3, 5, 7, 9, 11. 13 and 15, rollers 2, 4, 6, 8, 10, 12, 14 and 16 are provided. Five rollers 2, 6, 10, 14 and 16 out of these 8 rollers are pressed upward by a spring 37 and are pressure contacted to corresponding rollers 1, 5, 9, 13 and 15 by way of conveying path 101 and driven and rotated following these rollers.

Figure 3A:
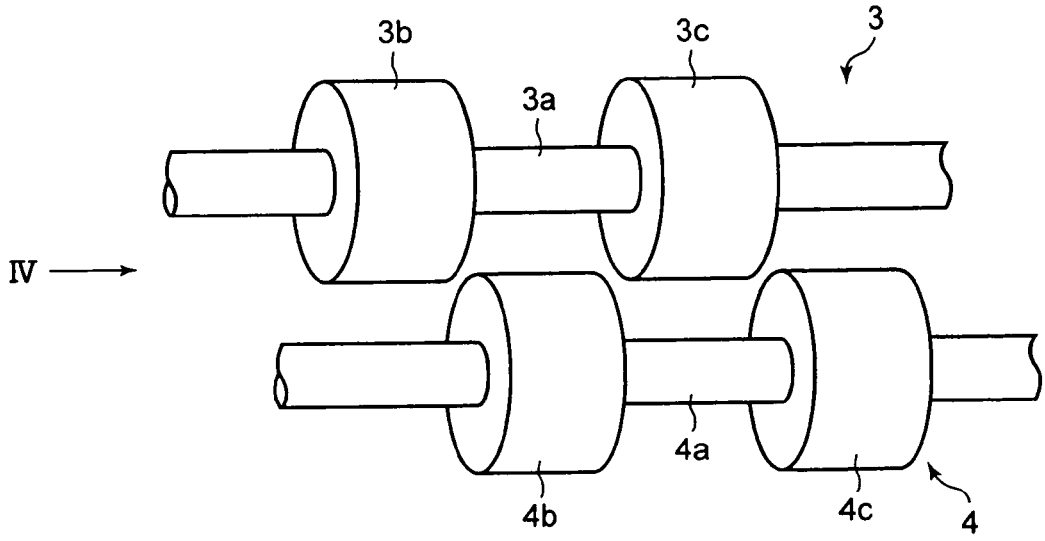
FIG. 3A is a partially enlarged perspective view showing a partially enlarged roller pairs incorporated in the apparatus shown in FIG. 1.
Figure 3B:
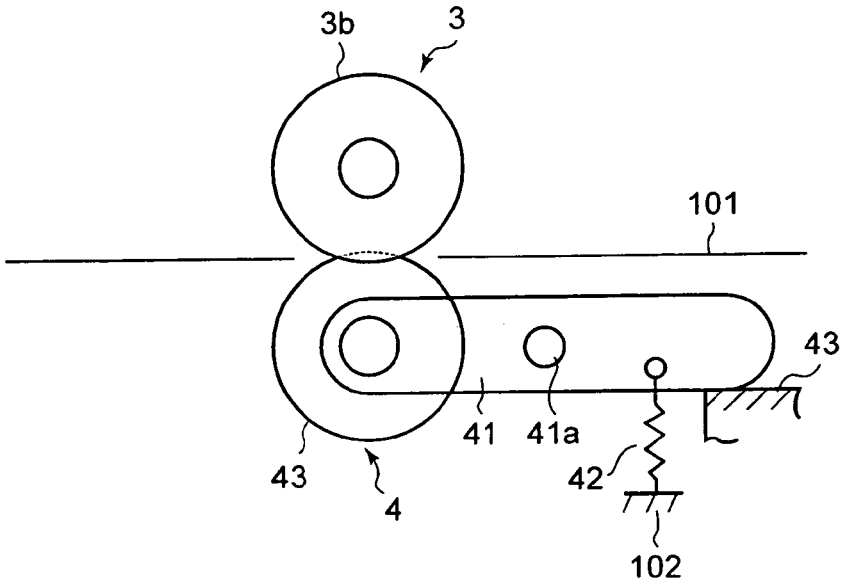
FIG. 3B is a partially enlarged front view of the roller pairs shown in FIG. 3A viewed from the direction of an arrow IV.

Rollers 4, 8 and 12 are pressed upward by a spring 42 through a swing arm 41 and are pressure contacted to corresponding rollers 3, 7 and 11 through conveying path 101 and are driven by contacting corresponding rollers 3, 7 and 11 as shown in FIG. 3B. Further, in FIG. 1 and FIG. 7~FIG. 14, swing arm 41 is not shown but spring 42 only is shown.

Further, the third roller 6 along the conveying direction functions as the second roller of this invention and the seventh roller 14 functions as a driven roller of this invention.

As shown in FIG. 2, motor 32 for rotating pick-up roller 31 and moving mechanism 34 for moving back-up plate 33 are connected to a controller 50 that controls the operations of apparatus 100. Further, a motor 17 for rotating the first roller 1, a motor 18 for rotating the second~the fourth rollers 3, 5 and 7 synchronously, a motor 20 for rotating the fifth roller 9, a motor 21 for rotating the sixth roller 11, a motor 22 for rotating the seventh roller 13, and a motor 24 for rotating the eight roller 15 are connected to controller 50. Further, a motor 19 to give a separation torque in the direction reverse to the conveying direction T to the other side (the lower side in FIG. 1) of conveying path 101 and a motor 13 to give a separation torque in the reverse direction to roller 14 are connected to controller 50.

Rollers 6 and 14 with a separation torque given by motors 19 and 23, respectively are rotated in the forward direction following the rotation of corresponding rollers 5 and 13, when no sheet S is present and when a single sheet S is present on conveying path 101 between corresponding rollers 5 and 13. On the other hand, when there are plural sheets S in the overlapped state (double sheets) between the rollers (hereinafter, this state is called as the double sheets conveying), rollers 6 and 14 applied with a separation torque in the reverse direction are decelerated, stopped or rotated in the reverse direction so as to separate a sheet S overlapped on a sheet S that is in contact with rollers 5 and 13.

Further, three sensors 26, 27 and 28 for detecting the passage of a sheet S conveyed on conveying path 1021, a detector 29 for detecting a rotating velocity of motor 19 to give a separation torque to roller 6. A memory 35 storing a control program and various control data of apparatus 100, and a timer 36 to get a control timing are connected to controller 50.

Three sensors 26, 27 and 28 are in the same structure and have a light-emitter and a light-receiver with conveying path 101 between them, respectively. And an optical axis connecting the light-emitter and the light-receiver is arranged to get across conveying path 101 at a specified position. First sensor 26 is arranged at a position where the optical axis passes through conveying path between rollers 9 and 11, second sensor 27 is arranged at a position where the optical axis passes through conveying path 101 between rollers 11 and 13, and third sensor 28 is arranged at a position where the optical axis passes through conveying path 101 between rollers 13 and 15.

Detector 29 detects the speed change of roller 6 by detecting the rotational velocity of motor 19 and functions as a double sheet conveying detector of the present invention to detect the conveying of sheets in the overlapped state; that is, the double sheet conveying. In other words, roller 6 rotates in the forward direction at the same velocity as roller 5 in the state where no sheet S is conveyed and a single sheet is being conveyed as described above. However, when sheets S in the overlapped state are conveyed between rollers 5 and 6, the overlapped sheets S are separated as the rollers are decelerated, stopped to rotate or rotated in the reverse direction. Therefore, the conveying of double sheets in the overlapped state can be detected by detecting the change in the rotating velocity of roller 6.

FIG. 3A shows a perspective view of the external appearance of roller pairs 3 and arranged immediately in front of roller 6 to detect the double sheet conveying. FIG. 3B is a partially enlarged front view of roller pairs 3 and 4. Roller pairs 9 and 10, and 11 and 12 are also in the same structure.

Roller 3 arranged above conveying path 101 in the figure is provided with two roller portions 3*b* and 3*c* which are separated each other along a rotary shaft 3*a*. As described above, a rotary shaft 3*a* of roller 3 is installed to a frame (not shown) rotatably as well as stationary and is connected to motor 18 via plural pulleys and a timing belt (not shown). Further, two roller portions 3*b* and 3*c* are formed with a slippery rubber.

On the other hand, driven roller 4*b* arranged below conveying path 101 in the figure is also provided with two rollers 4*b* and 4*c* which are separated each other along rotary shaft 4*a*. Both ends of rotary shaft 4*a* of roller 4 are installed to the end of swing arm 41 (only one end is shown in FIG. 3B) so as to able to swing. Swing arm 41 is installed to the frame (not shown) of apparatus 100 rotatably through rotary shaft 41*a*. At a point near the base end of swing arm 41, one end of spring 42 is attached. The other end of spring 42 is attached to a frame 102 of apparatus 100. Spring 42 generates a tensile strength to constantly press swing arm 41 in the direction to press roller 4 toward roller 3. A stopper 43 is contacted to the base portion of swing arm 41 at the illustrated position to regulate the swing. Stopper 43 is integrally provided to the frame of apparatus 101. Further, two roller portions 4*b* and 4*c* are formed with a relatively slippery resin.

Two rollers 3 and 4 described above have roller portions 3*b*, 3*c*, 4*b* and 4*c* in the nested state as shown in FIG. 3*a* and respective roller portions are positioned to that respective roller potions are partially overlapped (FIG. 3B). Therefore, it is necessary to stop roller 4 that is pressed by spring 42 with stopper 43. In other words, stopper 43 is arranged at a position able to control the movement of roller 4 at a position where roller portions 4*b* and 4*c* of roller 4 move slight over conveying path 101.

As described above, roller portions 3*b* and 3*c* of the driven side roller 3 are formed with resin and roller portions 3*b*, 3*c*, 4*b* and 4*c* of two rollers 3 and 4 opposing to each other are arranged in the nested state by shifting in the axial direction each other and therefore, the separating operation of sheets S conveyed in the overlapped state can be allowed. That is, these two rollers 3 and 4 are arranged at the upper stream of rollers 5 and 6 which function to separate sheets S conveyed in the overlapped state and therefore, sheets S conveyed in the overlapped state may be present between rollers 3 and 4. When sheets S conveyed in the overlapped state are present between rollers 3 and 4, the conveying force of sheets S that are to be separated is made weak as a proper conveying force is maintained by the actions of roller portions 3*b*, 3*c*, 4*b* and 4*c* in the nested state and roller portions 3*b* and 3*c* of the separation side roller 3 are formed with resin. That is, the clamping force of these roller portions 3*b*, 3*c*, 4*b* and 4*c* is set weaker than the clamping force of rollers 5 and 6. Further, the structure of rollers 3 and 4 are explained representatively here but rollers 7 and 8 provided at the downstream side of rollers 5 and 6 are also in the same structure.

Figure 5:
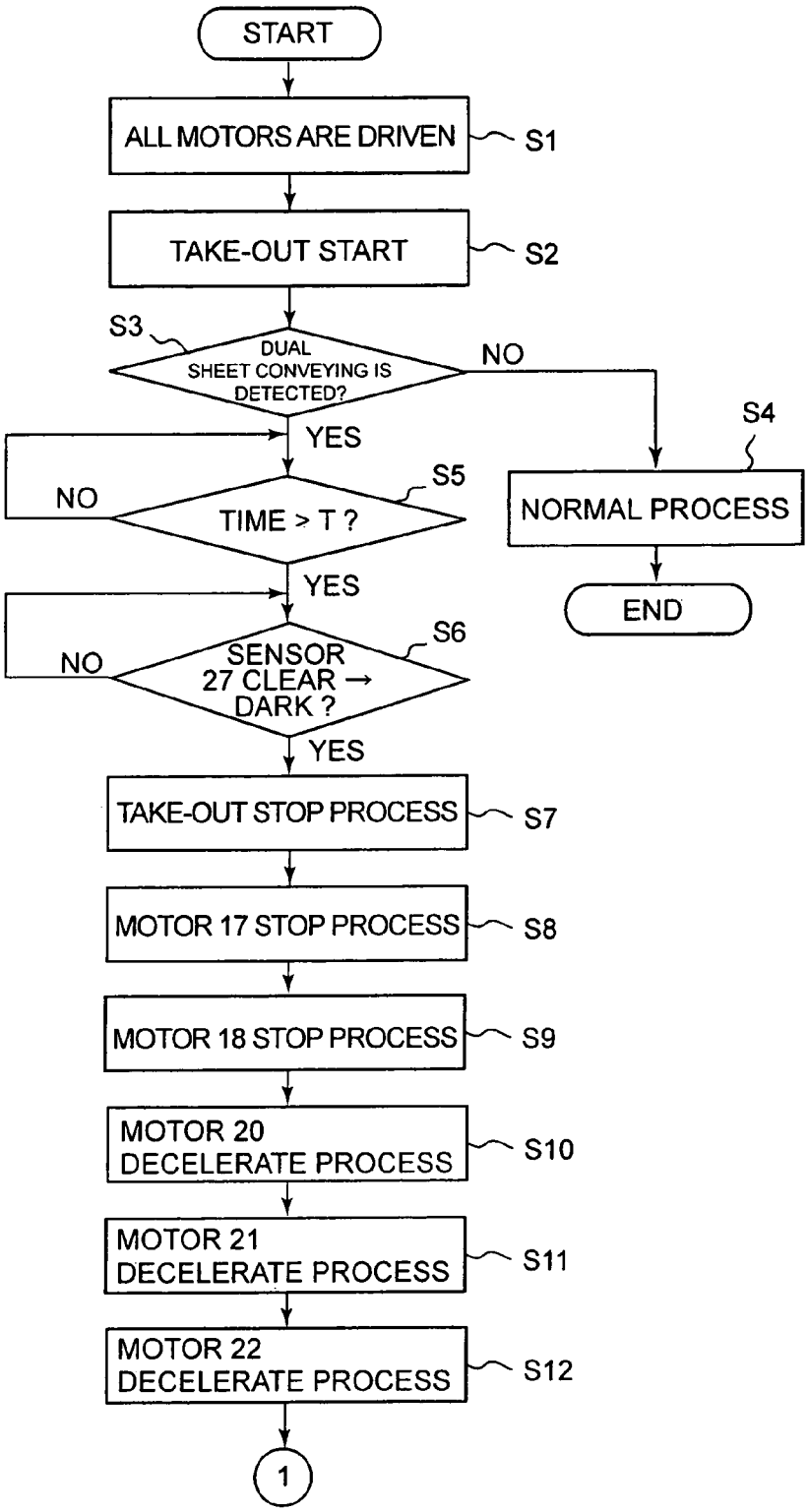
FIG. 5 is a flowchart for explaining an example of the operation by the apparatus shown in FIG. 1.
Figure 6:
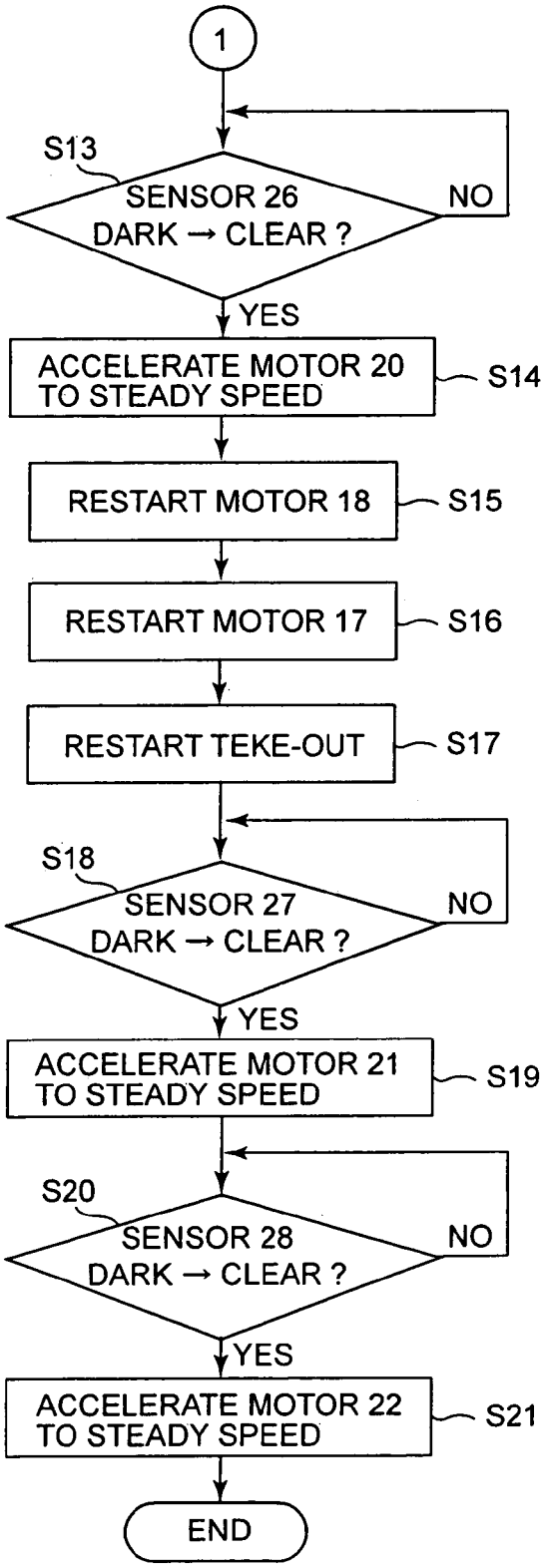
FIG. 6 is a flowchart for explaining an example of the operation by the apparatus shown in FIG. 5.

Next, examples of the process operation by apparatus 100 will be explained referring to FIG. 5 through FIG. 15. In FIG. 5 and FIG. 6, a flowchart for explaining an example of the operation of apparatus 100 is shown. Further, in FIG. 15, a timing chart for explaining the secular status change of sheets S in this operating example is shown. Further, in the timing chart shown in FIG. 15, the zero-base of sheets conveying position (the lateral axis) is made a nip between rollers 1 and 2 and the zero-base of elapsed time from the start of control is made the status shown in FIG. 7.

First, plural sheets S for objects of process are input into apparatus 100 through the input portion and all motors 27~24 except motor 32 of pick-up roller 31 are driven (FIG. 5: Step 1). At this time, motors 17, 18, 20, 21, 22 and 24 rotate rollers 1, 3, 5, 7, 9, 11, 13 and 15 in the forward direction, and motors 19 and 23 give a separation torque in the reverse direction to rollers 6 and 14. Under this state (the state without sheets conveyed), rollers 6 and 14 given with a separation torque are rotating in the forward direction following the rotation of rollers 5 and 13.

Further, at this time, moving mechanism 34 is driven and back-up plate 33 is moved, sheets S at the other end in the stacking direction out of sheets S input into the input portion are arranged at the specified take-out position and brought in contact with pick-up roller 31 at a specified pressing force.

Hereafter, motor 32 is drive, pick-up roller 31 is rotated in the forward direction and the take-out of sheets S is started (Step 2). Thus, sheets S taken out from the input portion are conveyed along conveying path 101 and conveyed to a processor at the latter stage as shown in the example of operation explained below. Further, in this example of operation, it is assumed that the third sheet S3 and the fourth sheet S4 taken out on conveying path 101 from the input portion are conveyed in the overlapped state (the double sheets conveying).

Figure 7:
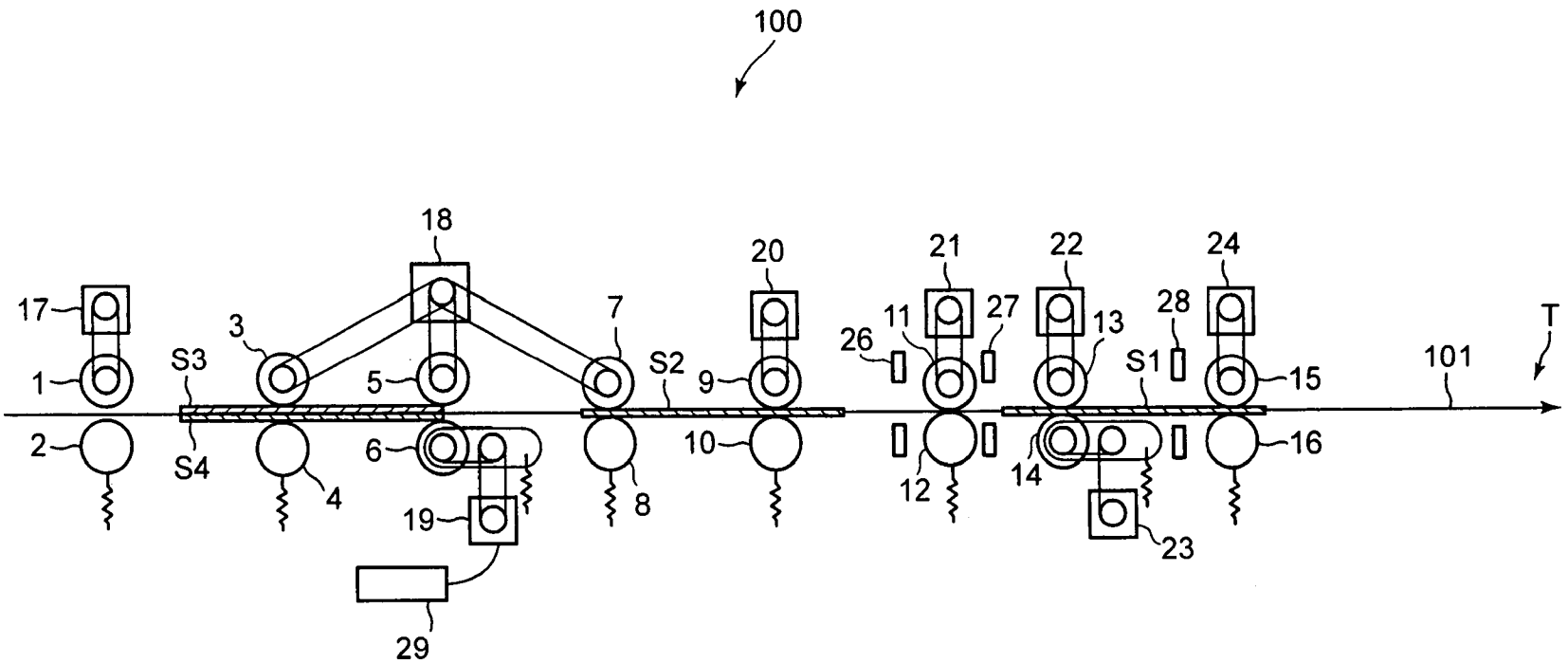
FIG. 7 is a diagram for explaining an example of the operation by the apparatus shown in FIG. 1.
Figure 8:
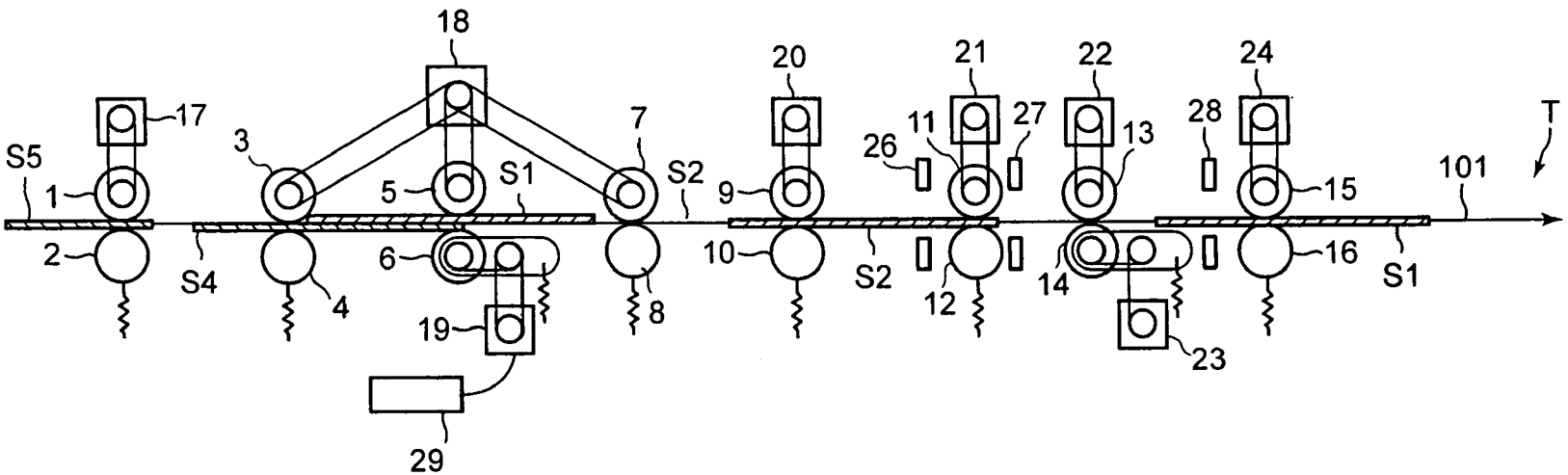
FIG. 8 is a diagram for explaining an example of the operation by the apparatus shown in FIG. 1.

As shown in FIG. 7, the first sheet S1 and the second sheet S2 taken out one by one are not detected as being in the overlapped state and therefore, are conveyed in the arrow direction T at an ordinary conveying velocity depending on the rotating velocity of rollers 1, 3, 5, 7, 9, 11, 13 and 15 to the processor at the latter stage (Step 3: NO, Step 4). At this time, a gap between sheets S1 and S2 depends upon the sheet S take-out timing by pick-up roller 31 and a gap between the normally taken-out sheets S becomes ideally constant.

Figure 15:
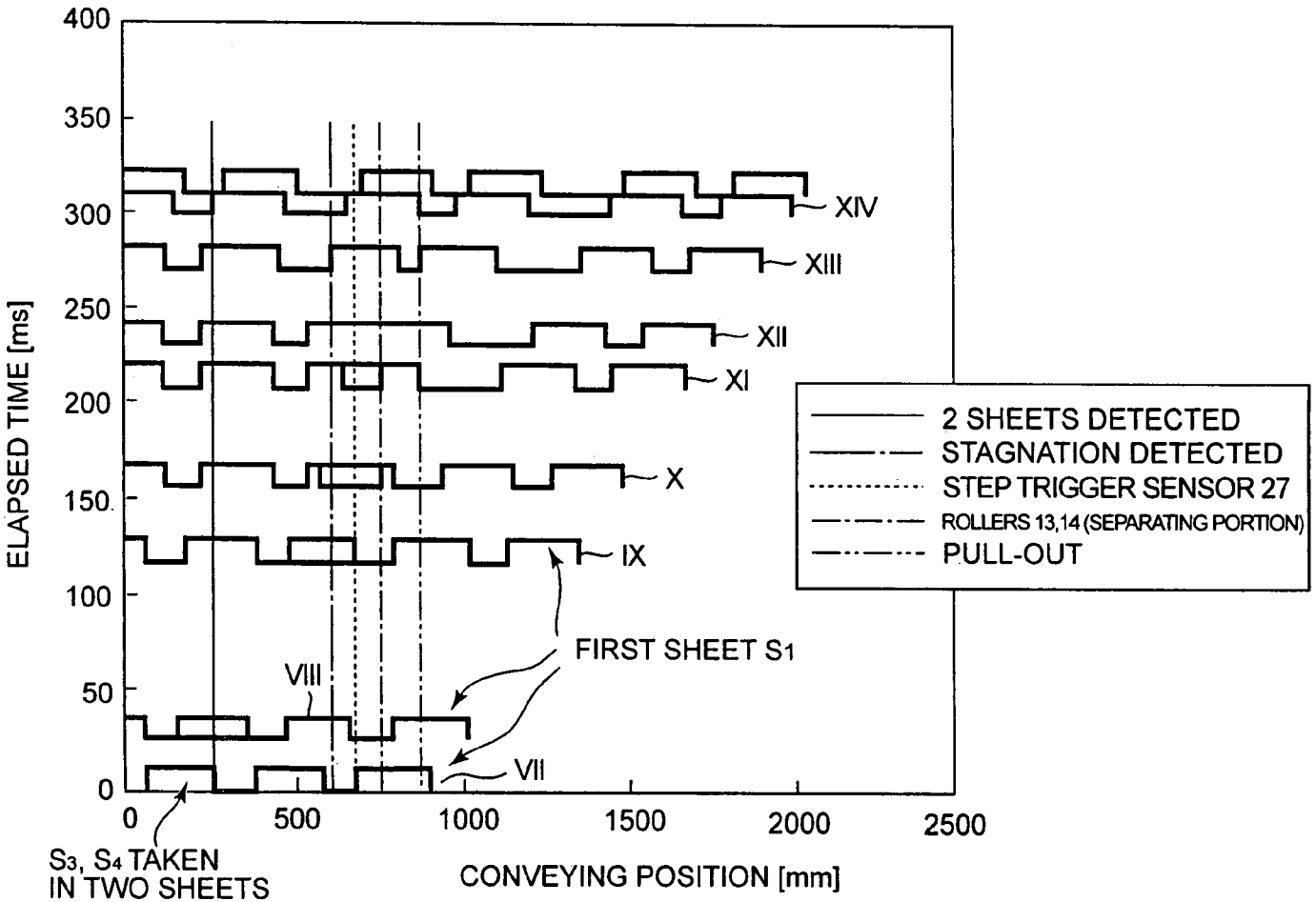
FIG. 15 is a timing chart for explaining the secular status change of sheets in the examples of the operation.

On the other hand, the front ends of the third and fourth sheets S3 and S4 in the overlapped state in the conveying direction arrive at the nip between rollers 5 and 6 as shown in FIG. 7 (FIG. 15: VII), the double sheets conveying of sheets S3 and S4 is detected by detector 29 (Step 3: YES). That is, when the front ends of the overlapped sheets S3 and S4 arrive at the nip between rollers 5 and 6, two sheets S3 and S4 are slipped each other by the action of roller 6 given with a separation torque given as show in FIG. 8 (FIG. 15: VIII). At this time, roller 6 is decelerated, stopped or reverse rotated and the velocity change at the time is detected by detector 29, and the conveying of sheets S3 and S4 in the overlapped state is detected.

When the conveying of overlapped sheets S3 and S4 is detected in Step 3, timer 36 is set and a time T from the detection of the overlapped sheet conveying until the front end of separated third sheet S3 in the conveying direction reaches sensor 27 (that is, a conveying time from the nip between rollers 5 and 6 to sensor 27) is counted. Then, at the time when a time T elapsed (Step 5: YES), whether sheet S3 reaches sensor 27 is judged (Step 6).

Figure 9:
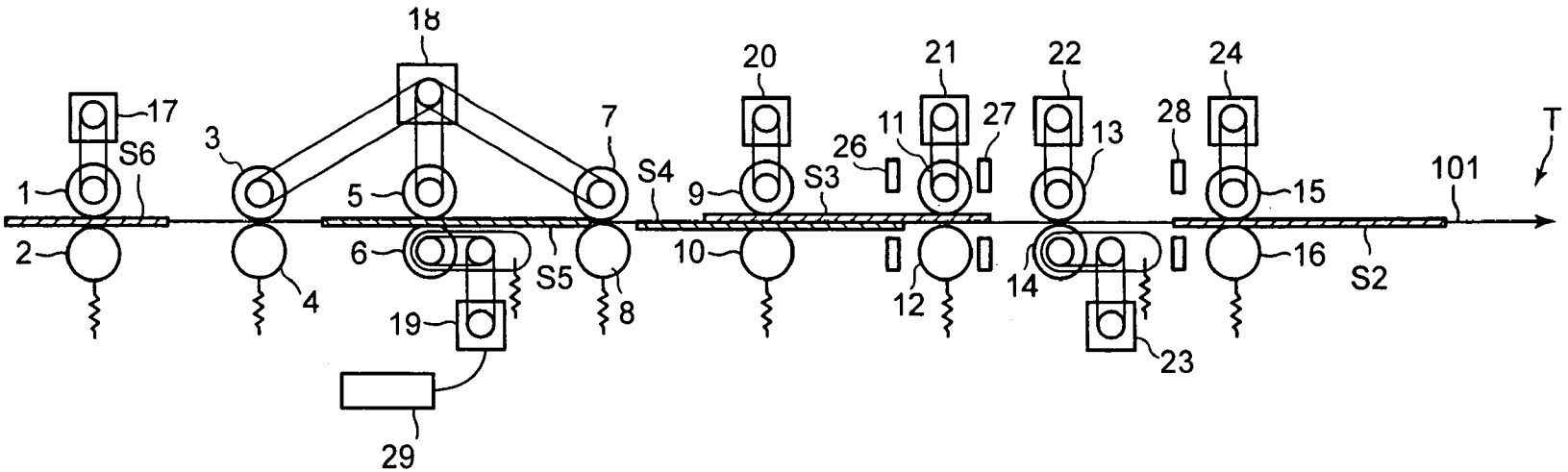
FIG. 9 is a diagram for explaining an example of the operation by the apparatus shown in FIG. 1.
Figure 10:
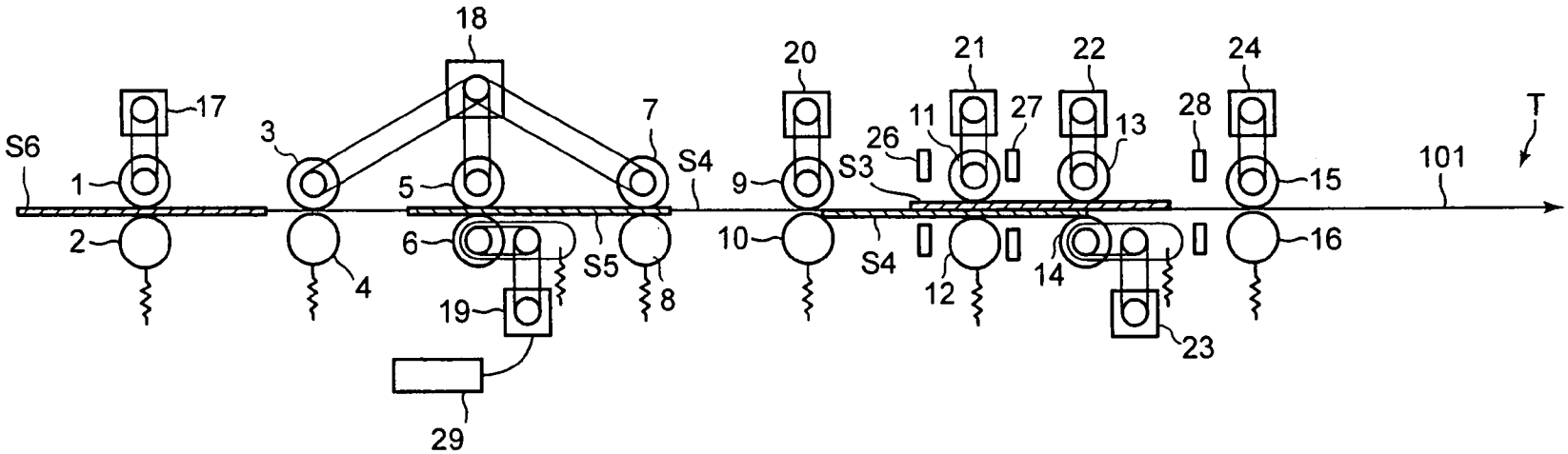
FIG. 10 is a diagram for explaining an example of the operation by the apparatus shown in FIG. 1.

As shown with IX in FIG. 9 and FIX. 15, when the front end of sheet S3 reaches sensor 27 (Step 6: YES), motor 32 is stopped, pick-up roller 31 is stopped and the sheet take-out operation is stopped (Step 7). In this embodiment, at the time when the front end of third sheet S3 reaches sensor 27, six sheets S1~S7 were already taken out on conveying path 101 and therefore, the take-out of seventh sheet and subsequent sheets S7~SN is stopped by the operation in Step 7. Further, fourth sheet S4 may be separated at the time when third sheet S3 reaches sensor 27.

Further, when third sheet S3 reaches sensor 27, motors 17 and 18 are stopped at the same time (Steps 8 and 9),the rotation of rollers 1, 3, 5 and 7 are stopped and motors 20, 21 and 22 are decelerated (Steps 10, 11 and 12) and the rotation of rollers 9, 11 and 13 is decelerated. Further, motor 24 is not stopped or decelerated at this time and roller 15 maintains the normal rotational velocity.

When rollers 1, 3, 5 and 7 are stopped in Steps 8 and 9, the conveying of the fifth and subsequent sheets S5 and S6 (two sheets in this embodiment) is stopped as shown by X in FIG. 15. Further, when rollers 9, 11 and 13 are decelerated in Steps 10, 11 and 12, the conveying speed of two overlapped sheets S3 and S4 is decelerated and the separating operation becomes easy.

Figure 11:
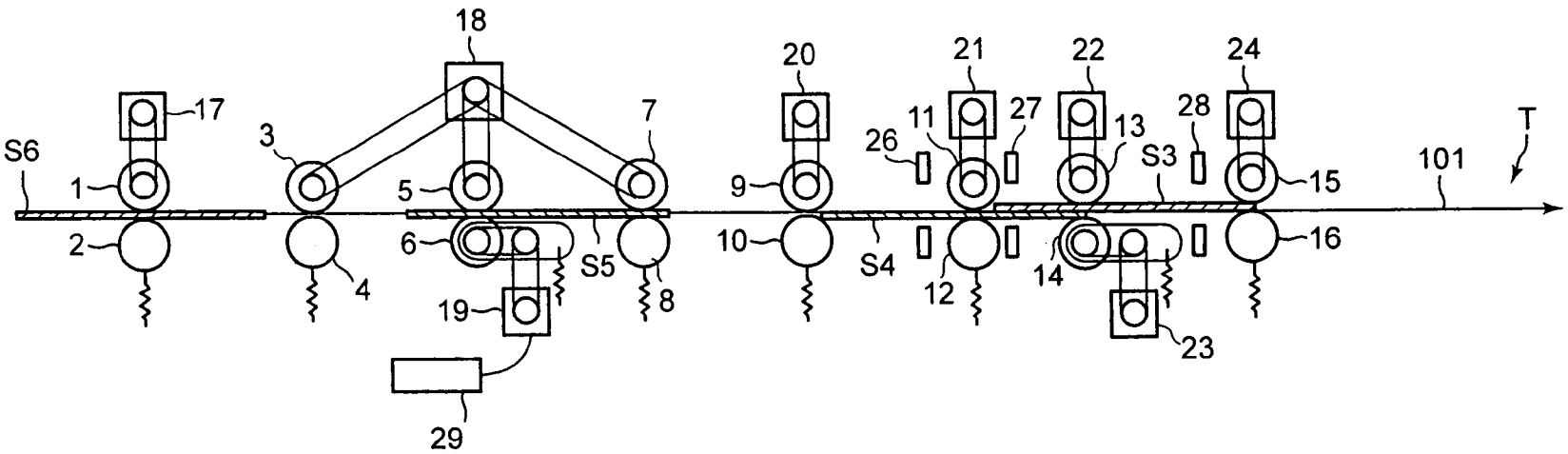
FIG. 11 is a diagram for explaining an example of the operation by the apparatus shown in FIG. 1.

In this state, fourth sheets S4 is separated from third sheet S3 by the action of roller 14 given with a separation torque and when the front end of third sheet S3 in the conveying direction reaches the nip between rollers 15 and 16, sheet S3 is pulled out by rollers 15 and 16 which are rotating at a normal velocity as shown by XI in FIG. 11 and FIG. 15. As a result, third sheet S3 is separated from fourth sheet S4.

Figure 12:
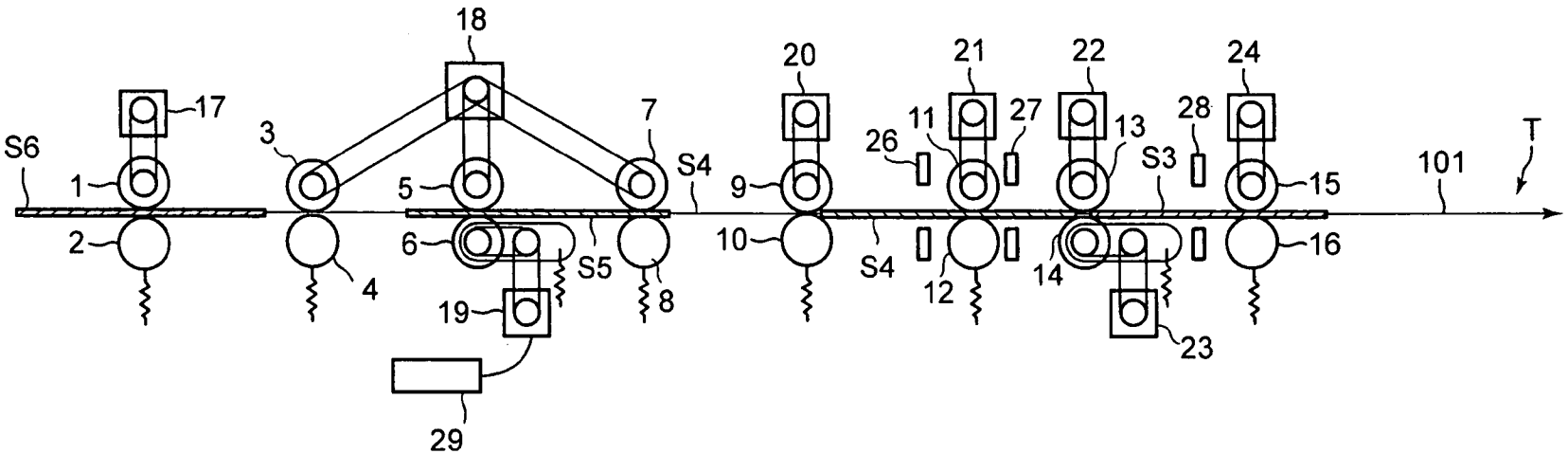
FIG. 12 is a diagram for explaining an example of the operation by the apparatus shown in FIG. 1.

More in detail, as shown in FIG. 11, the front end of third sheet S3 is pulled out in the state it is clamped and restricted in the nip between rollers 15 and 16 and the front end of fourth sheet S4 is stopped or retained there by reverse rotating roller 14 and thus, both sheets are separated. And, as shown in FIG. 12 (and FIG. 15: XII), after the rear end of third sheet S3 passed through the nip between rollers 13 and 14, the conveying force of roller 13 is transmitted to roller 14 and fourth sheet S4 is clamped and restricted by rollers 13 and 14 and the conveying is started again.

Figure 13:
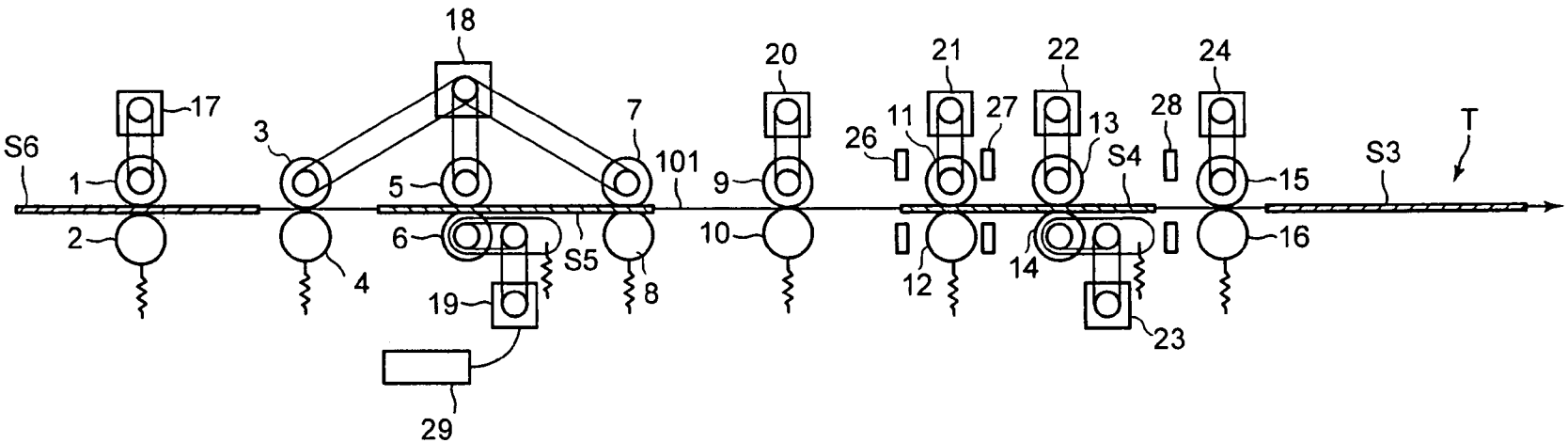
FIG. 13 is a diagram for explaining an example of the operation by the apparatus shown in FIG. 1.

At this time, preceding third sheet S3 is conveyed by clamped and restricted with rollers 15 and 16 which are rotating at the normal speed and succeeding fourth sheet S$ is conveyed by clamped and restricted with rollers 11~14 of which speed is decelerated. Therefore, a speed difference is generated between both sheets and a gap is produced between them as shown in FIG. 13 (FIG. 15; XIII).

Then, as shown in FIG. 13 (FIG. 15; XIII), by triggering that the rear end of fourth sheet S4 in the conveying direction passes sensor 26 and the sensor output changes from the dark to clear (FIG. 6; Step 13; YES), the completion of separation of two sheets S3 and S4 is judged, and the rotating velocity of motor 20 is returned to the normal velocity and roller 9 us rotated at the normal velocity (Step 14).

At the same time, motor 18 stopped in Step 9 is driven again (Step 15), motor 17 stopped in Step 8 is driven again (Step 16), rollers 1, 3, 5 and 7 are rotated and the conveying of succeeding sheets S5 and S6 that was stopped is started again. Further, at the same time, motor 32 stopped in Step 7 is driven again, pick-up roller 31 starts to rotate again, and the take-out of sheets is started again (Step 17).

Figure 14:
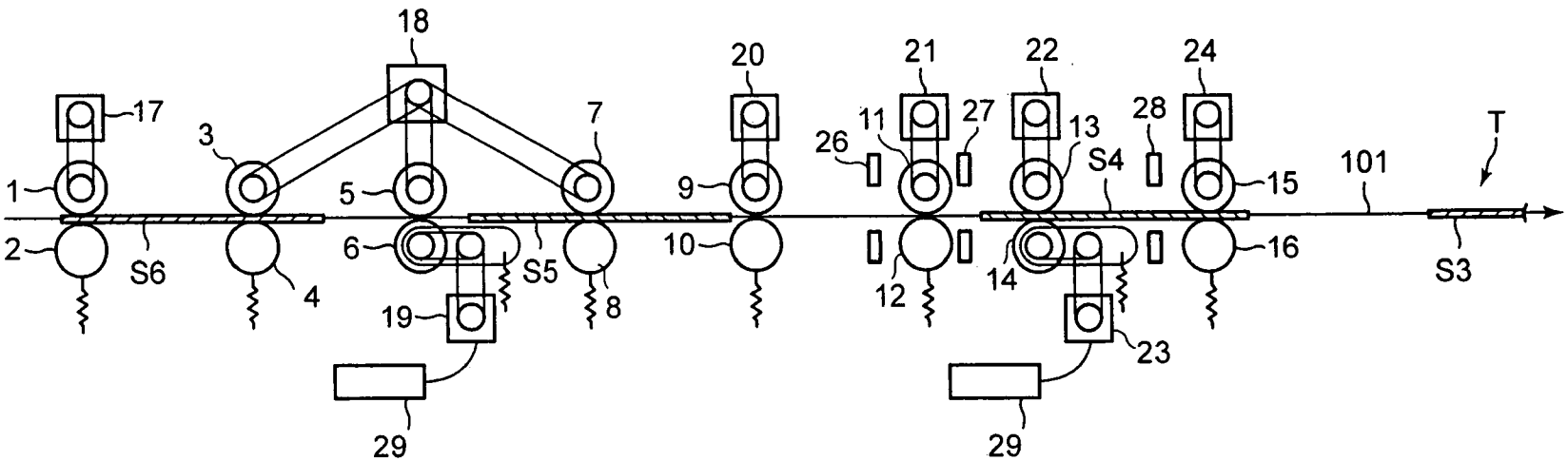
FIG. 14 is a diagram for explaining an example of the operation by the apparatus shown in FIG. 1.

Further, as shown in FIG. 14 (FIG. 15; XIV), when the rear end of fourth sheet S4 in the conveying direction passed sensor 27 and the sensor output was changed from dark to clear (Step 18; YES), motor 21 is returned to the normal rotating velocity and roller 11 is rotated at the normal rotating velocity (Step 19). Further, hereafter, when the rear end in the conveying direction of fourth sheet S$ passed and the sensor output changes from dark to clear (Step 10; YES), motor 22 is returned to the normal rotating velocity and roller 13 is rotated at the normal rotating velocity (Step 21). Under this state, all rollers are returned to the normal rotating velocity.

As described above, according to the above-mentioned operating example, even when the conveying of double sheets S was detected, the sheets conveyed in the overlapped state can be separated without rejecting them as before and the throughput of apparatus 100 can be maintained. Further, according to this embodiment, while sheets S are being conveyed on a single conveying path 101 extending from the sheet S input unit, all taken out sheets S can be separated certainly and conveyed and it is not required to provide another conveying path for rejected sheets or for returning sheets and thus, the apparatus can be made in a compact structure.

Figure 16:
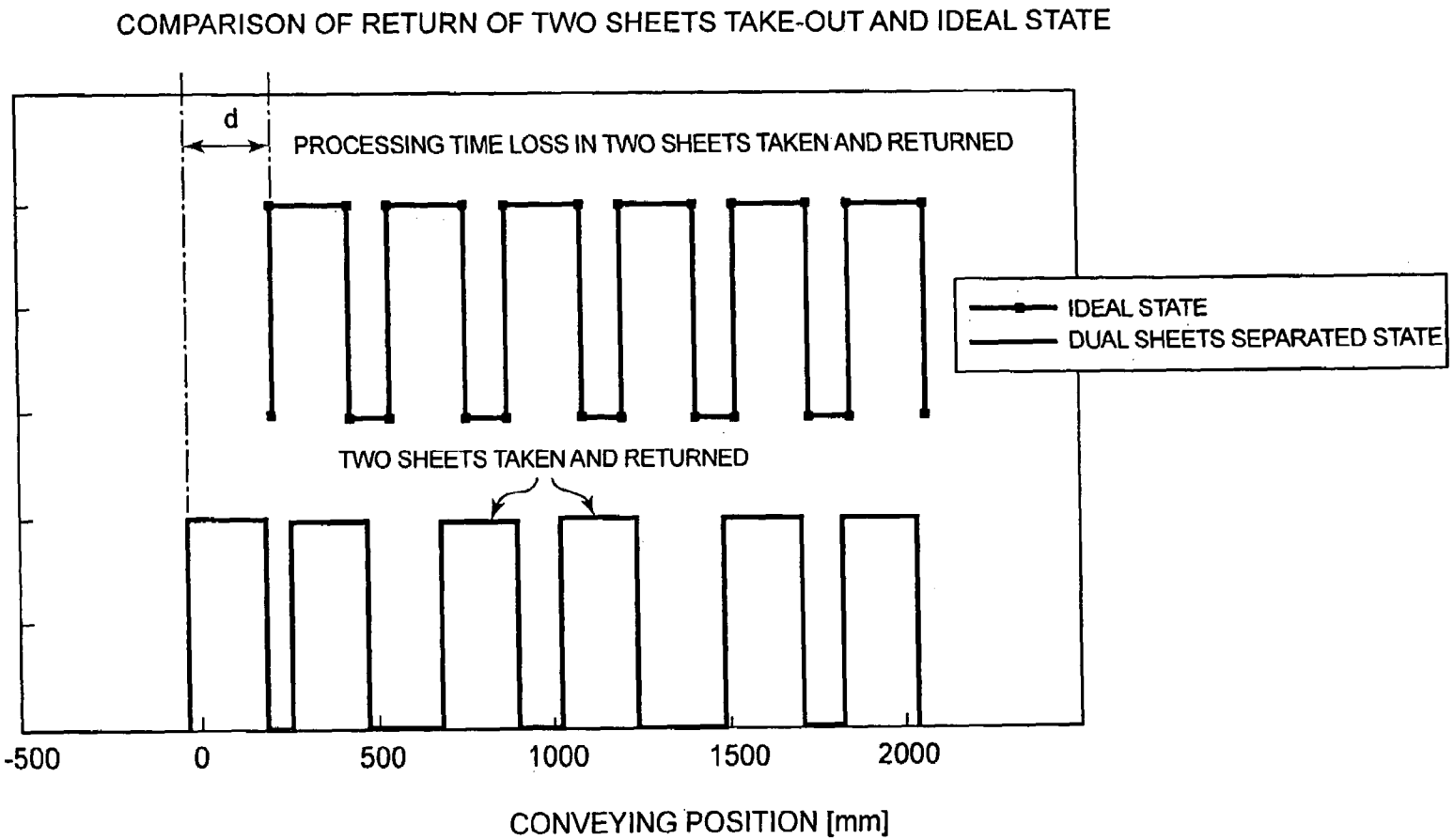
FIG. 16 is a graph for explaining losses in the example of the operation.

Further, as in the above-mentioned operating example, when, for example, the third sheet S3 and the fourth sheet S4 conveyed in the overlapped state were separated, the second sheet S2 and the fifth sheet S5 conveyed before or After can be continuously processed without impeding the conveying of them and a proper gap can be formed between the third sheet S3 and the fourth sheet S4. Definitely, as shown in FIG. 16, in this operating example, when the first~sixth sheets S1~S6 are processed, a processing time loss (d in FIG. 16) could be suppressed to below the length along the conveying direction of a single sheet when compared with the normal conveying without generating the overlapped sheet conveying (the ideal state). More definite, when assuming an apparatus 100 having a processing capacity of 4000 sheets/hour (at sheet conveying velocity 3.6 [m/s]), the above-mentioned time loss d is 227 [mm] in terms of distance and about 63 [ms] when converted into a time.

Figure 4:
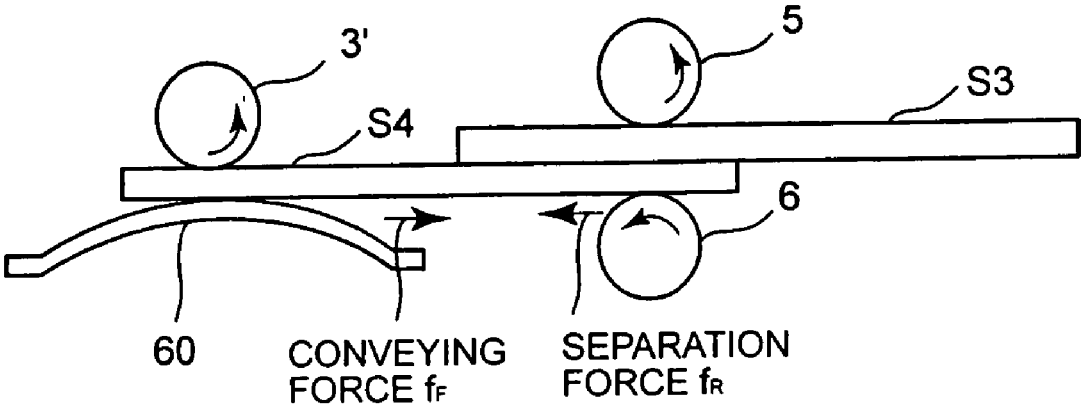
FIG. 4 is a front view showing a modified example of the roller pairs shown in FIG. 3A and FIG. 3B.

In stead of using rollers 3 and 4 shown in FIG. 3, the apparatus may be constructed as shown in FIG. 4. That is, a plate spring shape guide plate 60 is provided to function as a pressing member to press sheets S against roller 3'. Guide plate 60 is formed by bending a resin plate member and is extending along the conveying direction sheets S. Its upper stream side end in the conveying direction is attached to a frame (not shown). Sheets S are conveyed by rotation of roller 3' in the forward direction and the slippery surface of guide plate 60. A separation force FR produced by the rotation of roller 6 of the roller pairs 5 and 6 is larger than a conveying force FF of roller 3' opposite to guide plate 60 and it is therefore possible to leave sheet S4 of sheets S3 and S4 conveyed in the overlapped state and precede sheet S3.

Further, the present invention is not restricted to the above-mentioned embodiment but can be embodied by modifying components of the apparatus without departing from the spirit and scope thereof at the stage of embodiment. Further, various inventions can be derived by properly combining a number of component elements disclosed in the above-mentioned embodiment. For example, some of component elements may be omitted from whole component elements disclosed in the above-mentioned embodiment.

For example, in the above example, a case when detector 29 was adopted for detecting change in the rotational velocity of roller 6 as a detector of plural sheets conveyed in the overlapped state is explained but not restricting to this, such type of a detector as that to detect the dual sheets conveying by detecting a thickness of sheets S being conveyed may be adopted.

Further, locations and number of plural rollers on the conveying path can be changed properly according to a length and a thickness of a sheet that is a subject of processing along the conveying direction and not restricted to the embodiment described above.

What is claimed is:

1. A sheets separation/conveying apparatus comprising:

a take-out portion configured to take out sheets on a conveying path by rotating a pickup roller in contact with sheets at the end of a stacking direction;

a conveying portion configured to convey the sheets that are taken out on onto a conveying path;

an overlapped sheets detector configured to detect a plurality of sheets being conveyed in a overlapped state on the conveying path;

a separating portion provided on the conveying path at a downstream side from the overlapped sheets detector and along the conveying direction, and the separating portion configured to separate the sheets conveyed in the overlapped state from each other; and a controller configured to stop the operation of the take-out portion and to reduce conveying speed of the separating portion to achieve a predetermined gap between the separated sheets, in accordance with a detection of the sheets in an overlapped state.

2. The sheets separation/conveying apparatus as set forth in claim 1, wherein the controller stops the conveying of the sheets taken out on the conveying path after the overlapped sheets, when the conveying of sheets in the overlapped state is detected.

3. The sheets separation/conveying apparatus as set forth in claim 2, wherein the controller resumes the sheets take-out operation after overlapped sheets are separated by the separating portion and resumes the conveying of the sheets taken out on the conveying path after the overlapped sheets, and controls the take-out portion and the conveying portion.

4. The sheets separation/conveying apparatus as set forth in claim 1, further comprising, a first roller configured to rotate in the forward direction to convey sheets along the conveying path, and a second roller, that is in contact with the first roller, and configured to follow the rotation of the first roller, wherein the overlapped sheets detector detects a rotating velocity of the second roller provides a separation torque in the reverse direction of the conveying direction to sheets conveyed between the first roller and the second roller, and detects the conveying of the overlapped sheets based on the change in the rotating velocity of the second roller.

5. The sheets separation/conveying apparatus as set forth in claim 4, wherein the conveying portion includes a conveying unit provided adjoining to the upper stream side of the first and second rollers to convey the sheets pinched with weak force than the pinch force by the first and second rollers.

6. The sheets separation/conveying apparatus as set forth in claim 4, wherein the conveying portion has roller pairs arranged adjoining to the upper stream side of the first and second rollers along the conveying direction, and these roller pairs have plural rollers separated each other in the axial direction, respectively and the rollers are so arranged as to partially overlap in the nested state on the conveying path.

7. The sheets separation/conveying apparatus as set forth in claim 4, wherein the conveying portion includes a conveying roller arranged adjoining to the upper stream side of the first and second rollers and a pressing member to press the sheets against the roller, and a separation force by a separation torque given to the second roller is set larger than the conveying force of the conveying roller in contact with the pressing member.

8. The sheets separation/conveying apparatus as set forth in claim 7, wherein the pressing member is formed by bending a resin made plate shape member.

9. The sheets separation/conveying apparatus as set forth in claim 1, wherein the separating portion comprises:

a driving roller that rotates in a forward direction to convey the sheets; and a separation roller arranged in contact with the driving roller through the conveying path, rotates in a manner that follows the driving roller when there is no overlapped sheets, and provides separation torque in the direction reverse to the conveying direction to sheets that are conveyed between the driving rollers.

10. The sheets separation/conveying apparatus as set forth in claim 9, wherein the conveying portion includes a first roller pair arranged on the upper stream side of the separating portion along the conveying direction, the overlapped sheets are composed of first and second sheets, and the controller controls to reduce speed of the first roller pair and the driving roller so that the first and second sheets can be easily separated from each other when the overlapped sheets are held between the first roller pair and between the driving roller and the separation roller.

11. The sheets separation/conveying apparatus as set forth in claim 10, wherein the conveying portion includes a second roller pair arranged on the down stream side of the separating portion along the conveying direction and to rotate higher at speed than the first roller pair and the driving roller, and the controller controls to pull and convey the first sheet from the second roller pair and to stop the second sheet from conveying by the separation torque of the separation roller when the overlapped sheets are held between the first roller pair and between the driving roller and the separation roller.

12. The sheets separation/conveying apparatus as set forth in claim 11, wherein the controller controls to make the driving roller and the separation roller start conveying again the second sheets which have been held between the driving roller and the separation roller when the first sheet is released from being held between the driving roller and the separation roller.

13. The sheets separation/conveying apparatus as set forth in claim 12, wherein the controller controls to make the second roller pair hold and convey the first sheet and make the driving roller and the separation roller hold and convey the second sheet slower at speed than the second roller pair so that conveying speed differences between the first and second sheets define a gap between the same.

* * * * *